US010843057B2

(12) United States Patent
Harris et al.

(10) Patent No.: US 10,843,057 B2
(45) Date of Patent: Nov. 24, 2020

(54) HANDLE FOR DANCE PRACTICE ASSEMBLY

(71) Applicants: Stephanie Harris, Los Angeles, CA (US); Paul Zunno, Los Angeles, CA (US)

(72) Inventors: Stephanie Harris, Los Angeles, CA (US); Paul Zunno, Los Angeles, CA (US)

( * ) Notice: Subject to any disclaimer, the term of this patent is extended or adjusted under 35 U.S.C. 154(b) by 265 days.

(21) Appl. No.: 15/845,465

(22) Filed: Dec. 18, 2017

(65) Prior Publication Data

US 2019/0184255 A1 Jun. 20, 2019

(51) Int. Cl.
*A63B 69/00* (2006.01)
*A63B 26/00* (2006.01)

(52) U.S. Cl.
CPC ..... *A63B 69/00* (2013.01); *A63B 26/003* (2013.01); *A63B 69/0057* (2013.01); *A63B 2225/09* (2013.01); *A63B 2244/22* (2013.01)

(58) Field of Classification Search
CPC ..... A63B 69/00; A63B 2244/22
USPC ..... 434/250
See application file for complete search history.

(56) References Cited

U.S. PATENT DOCUMENTS 775,989 A * 11/1904 Roberts ..... A63B 21/0552 482/129
1,815,443 A 7/1931 Mitchell
3,458,188 A 7/1969 Infante
3,677,543 A 7/1972 Richardson
4,073,490 A 2/1978 Feather
4,733,862 A 3/1988 Miller
4,909,505 A 3/1990 Tee
5,317,788 A 6/1994 Esposito et al.
5,362,295 A 11/1994 Nurge
5,380,258 A 1/1995 Hawley, Jr.
5,556,369 A 9/1996 Roberts
5,571,064 A 11/1996 Holm
5,647,827 A 7/1997 Gutkowski et al.
(Continued)

OTHER PUBLICATIONS

"Cable Crossover Handle," Atlantis Fitness, https://web.archive.org/web/20160706052444/https://www.exercise-equipment-parts.com/cable-handle-rubber-grip.html, Jul. 6, 2016 (Year: 2016).*
(Continued)

*Primary Examiner* — James B Hull
*Assistant Examiner* — Jennifer L Korb
(74) *Attorney, Agent, or Firm* — Roeder & Broder LLP; James P. Broder

(57) ABSTRACT

A dance practice assembly includes an object that is selectively stationary, a tether assembly and a first handle. The first handle is configured to be coupled via the tether assembly to the object. The first handle includes a first leg and a second leg. The first leg has a first length and a somewhat elliptical cross-sectional shape. The second leg has a second attachment length that is different than the first length. The second leg is also approximately parallel to the first leg. The first handle further includes a third leg that connects the first leg to the second leg, where the third leg is approximately perpendicular to both the first leg and the second leg. The dance practice assembly can further include a second handle that is coupled to the first handle, with the second handle being substantially similar to the first handle.

17 Claims, 5 Drawing Sheets

(56) References Cited

U.S. PATENT DOCUMENTS

| | | | | |
|---|---|---|---|---|
| 5,740,994 | A * | 4/1998 | Laughlin | F16L 3/23 248/58 |
| 6,319,179 | B1 | 11/2001 | Hinds | |
| 6,524,226 | B2 | 2/2003 | Kushner | |
| 6,565,048 | B1 * | 5/2003 | Meyer | F16L 3/243 248/58 |
| 6,662,651 | B1 | 12/2003 | Roth | |
| 7,044,896 | B2 | 5/2006 | Hetrick | |
| 7,169,094 | B2 | 1/2007 | Ardito, III | |
| 7,214,171 | B2 | 5/2007 | Thelen et al. | |
| 7,326,157 | B2 | 2/2008 | Wu | |
| 7,455,632 | B2 | 11/2008 | Block et al. | |
| 7,625,325 | B1 | 12/2009 | Yost | |
| 7,828,703 | B1 | 11/2010 | Boesch | |
| D628,877 | S | 12/2010 | Stevens | |
| 8,109,863 | B2 | 2/2012 | Gilberti et al. | |
| 8,276,351 | B1 | 10/2012 | Henkin | |
| 9,573,016 | B2 | 2/2017 | Haddad et al. | |
| 10,300,326 | B2 | 5/2019 | Warren | |
| 2009/0051131 | A1 | 2/2009 | Warrington | |
| 2012/0289382 | A1 | 11/2012 | Haddad et al. | |
| 2014/0113777 | A1 | 4/2014 | Pahl | |
| 2015/0283421 | A1 | 10/2015 | Gaylord | |
| 2017/0036055 | A1 | 2/2017 | Fleming | |
| 2018/0133540 | A1 * | 5/2018 | McCrea | A63B 21/154 |

OTHER PUBLICATIONS

"Cable Handle Attachment—Rubberized Grip," Atlantis Fitness, https://web.archive.org/web/20160706062246/http://www.exercise-equipment-parts.com/exercise-cable-attachment-handle-rubberized-grip.html, Jul. 6, 2016 (Year: 2016).*

"Everbilt Heavy-Duty Multi-Use Garage Screw-In Hooks Value Pack (8-Pack)," homedepot.com, https://www.homedepot.com/p/Everbilt-Heavy-Duty-Multi-Use-Garage-Screw-In-Hooks-Value-Pack-8-Pack-17954/202249701, Aug. 13, 2013 (Year: 2013).*

"CAB Heavy Duty J-Hooks," CAB Products, https://web.archive.org/web/20140827094130/https://www.cabproducts.com/heavy-duty-j-hooks/, Aug. 27, 2014 (Year: 2014).*

"Understanding J-Hooks in Cable Support Systems," fs.com, https://web.archive.org/web/20170726061750/https://community.fs.com/blog/understanding-j-hooks-in-cable-support-systems.html, Oct. 20, 2016 (Year: 2016).*

"Platinum Tools® 90 Degree Angled Cable Cage Polypropylene J-Hook (Sold as Each)," Platinum Tools, https://web.archive.org/web/20150908110215/http://www.a1components.com/Products/Platinum-Tools-90-Degree-Angled-Cable-Cage-Polypropylene-J-Hook-(Sold-as-Each)_PLA1092AC.aspx, Sep. 8, 2015 (Year: 2015).*

* cited by examiner

HANDLE FOR DANCE PRACTICE ASSEMBLY

BACKGROUND

Dance routines can be practiced alone and/or with a dance partner. Often times, practicing alone may be the only option for a dancer. When practicing alone, the dancer does not benefit from the presence of the dance partner, who can provide feel and force to the dance routine. For example, when the dancer and the dance partner step apart while holding hands, each dancer can feel the force applied from the others hand, and this force can assist the dancers as they maneuver to different positions as part of the dance routine. Alternatively, when the option of practicing the dance routine with a dance partner is accessible, it may only be ideal when the dance partner is at least as skilled as the dancer. Unfortunately, a suitably skilled dance partner may not always be available. In such a case, the dancer may be left with the options of practicing alone or with an inept dance partner, or paying to practice with a suitably skilled dance partner.

SUMMARY

The present invention is designed to simulate a dance partner for practicing dance routines. More specifically, the present invention is directed toward a first handle for a dance practice assembly. In various embodiments, the dance practice assembly can include an object that is selectively stationary, a tether assembly and the first handle.

In certain embodiments, the first handle can be configured to be coupled via the tether assembly to the object. The first handle can include a first leg and a second leg. In various embodiments, the first leg can include a first length. The second leg can include a second attachment length. In some embodiments the first length is different than the second attachment length. In other embodiments the first length is greater than the second attachment length. For example, the first length can be at least approximately 50% greater than the second attachment length. In alternative embodiments, the first length can be approximately 100% greater than the second attachment length.

In various embodiments, the first leg can have a somewhat elliptical cross-sectional shape. In certain embodiments, the second leg can be approximately parallel to the first leg. Additionally, the second leg can be configured to be secured to the tether assembly.

In some embodiments, the first handle can further include a third leg that connects the first leg to the second leg. In certain embodiments, the third leg can be approximately perpendicular to each of the first leg and the second leg.

In certain embodiments, the first leg and the second leg can include a handle body and a body cover. The handle body can be formed from a metal, a composite material or a plastic, as non-exclusive examples. In certain embodiments, the body cover can cover at least a portion of the handle body. The body cover can be formed from a rubber or a plastic material, as non-exclusive examples.

In various embodiments, the dance practice assembly can include the first handle and the tether assembly that is secured to the first handle. The dance practice assembly can further include the object, which has been configured to remain substantially stationary during use of the dance practice assembly. The object can also be connected to the tether assembly.

In certain embodiments, the dance practice assembly can further include a second handle that can be coupled to the first handle, wherein the second handle can be substantially similar to the first handle.

Additionally, the present invention is directed toward a first handle for a dance practice assembly. In certain embodiments, the first handle can be configured to be coupled via a tether assembly to an object that is selectively stationary. In various embodiments, the first handle can include a first leg and a second leg. In such embodiments, the second leg can be configured to be secured to the tether assembly. Additionally, the second leg can be approximately parallel to the first leg.

In certain embodiments, the first handle can further include a third leg that connects the first leg to the second leg. In various embodiments, the third leg can be substantially linear. Additionally, the third leg can be approximately perpendicular to each of the first leg and the second leg.

In other embodiments, the first leg, the second leg and the third leg can be homogeneously formed as a unitary structure.

In various embodiments, the dance practice assembly can include the first handle, a second handle and the tether assembly that is configured to be secured to the object, the first handle and the second handle. In certain embodiments, the second handle can be substantially similar to the first handle.

Furthermore, the present invention is directed toward a first handle for a dance practice assembly. In certain embodiments, the first handle can be configured to be coupled via a tether assembly to an object that is selectively stationary. In various embodiments, the first handle can include a first leg, a second leg and a third leg. The first leg can have a first length and a somewhat elliptical cross-sectional shape. The second leg can be configured to be secured to the tether assembly and can be approximately parallel to the first leg. Additionally, the second leg can have a second attachment length. In various embodiments, the second attachment length can be shorter than the first length.

In certain embodiments, the third leg can connect the first leg to the second leg. In such embodiments, the third leg can be approximately perpendicular to each of the first leg and the second leg.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a handle for a dance practice assembly. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar nomenclature and/or reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
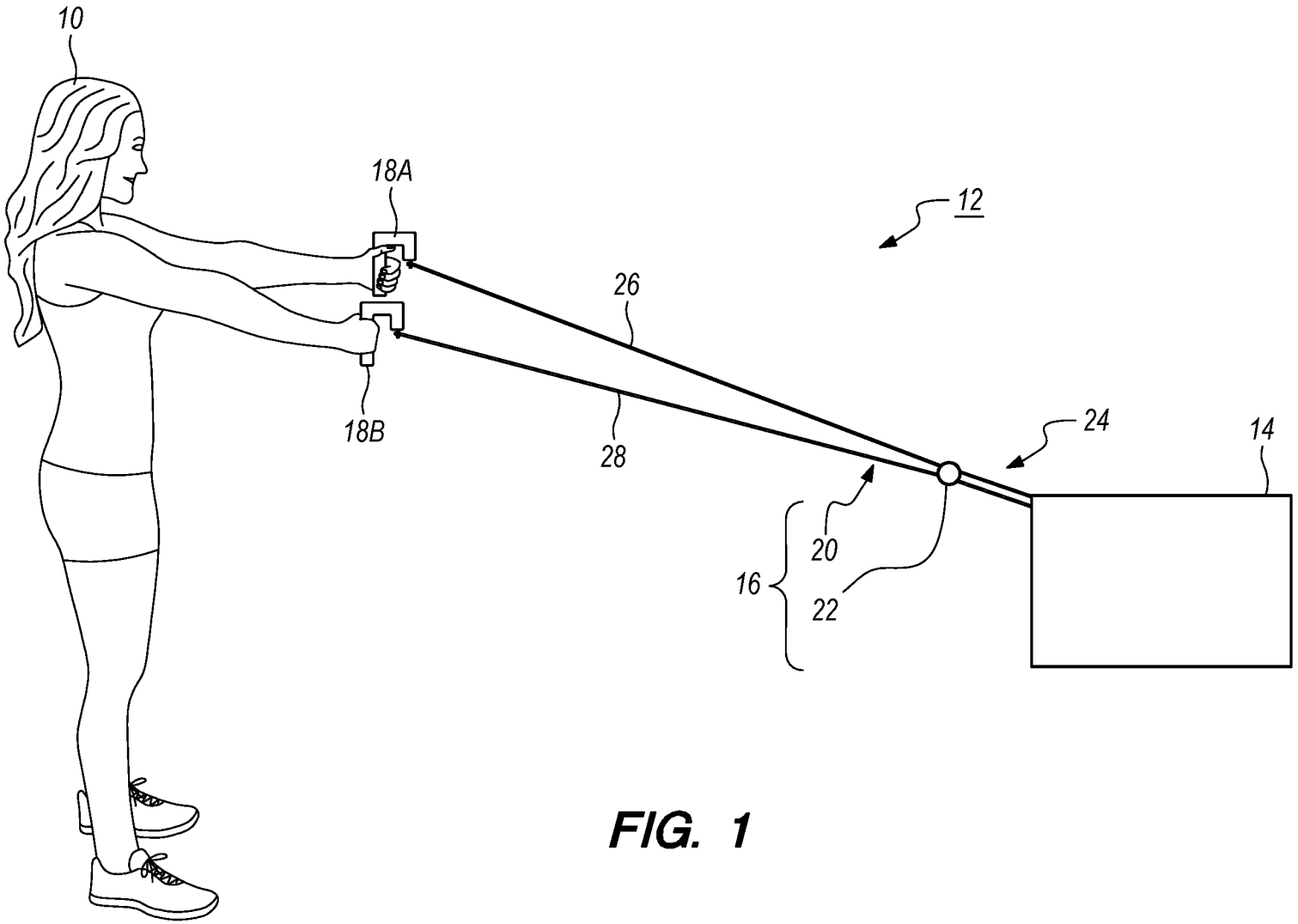
FIG. 1 is a perspective view of a dancer and one embodiment of a dance practice assembly having features of the present invention.

FIG. 1 is a perspective view of a dancer 10 and one embodiment of a dance practice assembly 12. The design and/or configuration of the dance practice assembly 12 can be varied. In certain embodiments, such as the embodiment illustrated in FIG. 1, the dance practice assembly 12 can include one or more of an object 14, a tether assembly 16 and one or more handles 18A, 18B (two handles are illustrated in FIG. 1, for example). It is understood that the dance practice assembly 12 can include fewer or additional components than those specifically illustrated and described herein.

In various embodiments, the object 14 can be configured to remain substantially stationary during use of the dance practice assembly 12. As used herein, "substantially stationary" means that the object 14 either does not move and/or negligibly moves during use, such that any movement may not be noticed and/or felt by the dancer 10. Further, as used herein, the term "selectively stationary" refers to the fact that some such objects 14 are capable of being moved, however, during use such objects 14 are intended to remain stationary. For example, in one embodiment, the object 14 can include a weighted bag. In other embodiments, the object 14 can include any other suitable weighted object. As other non-exclusive examples, the object 14 can include a door, a door jamb, a door knob and/or a pole. Additionally, and/or alternatively, the object 14 can include any other suitable object. In an alternative embodiment, the object can be movable during use, if desired.

The tether assembly 16 is configured to selectively connect, secure and/or attach to the object 14. As certain non-exclusive examples, the tether assembly 16 can be connected, secured and/or attached to the object 14 via a clamp and/or a knot. Alternatively, the tether assembly 16 can be selectively connected, secured and/or attached to the object 14 via any other suitable manner and/or method. The design and/or configuration of the tether assembly 16 can vary. In various embodiments, the tether assembly 16 can include one or more of a tether member 20 and an adjustable member 22. It is understood that the tether assembly 16 can include fewer or additional components than those specifically illustrated and described herein. For example, in some embodiments, the tether assembly 16 may omit the adjustable member 22.

In various embodiments, the type and/or style of the tether member 20 can vary. As non-exclusive examples, the tether member 20 can include a rope, a cord, a bungee and/or a cable. Alternatively, the tether member 20 can include any other suitable type and/or style of tether. In certain embodiments, the resistance of the tether member 20 can also vary depending on the specific design requirements of the dance practice assembly 12. For example, in some embodiments, the tether member 20 can be flexible, resilient and/or elastic. In other embodiments, the tether member 20 can be inflexible and/or rigid. Additionally, and/or alternatively, the tether member 20 can include a length that is variable.

In the embodiment illustrated in FIG. 1, the tether member 20 is connected, secured and/or attached to the object 14 at or near a central end 24 of the tether member 20. The central end 24 essentially divides the tether member 20 into two sides 26, 28. Stated another way, the first tether side 26 and the second tether side 28 can be substantially proportional relative to the central end 24. It is recognized that the "first tether side 26" and the "second tether side 28" can be used interchangeably. In various embodiments, the first tether side 26 and the second tether side 28 can be substantially the same length as the other.

The adjustable member 22 can be selectively moved and/or adjusted along the tether member 20. The design of the adjustable member 22 can vary. The adjustable member 22 can include one of a fastener, a cord lock, a clip, a clamp and/or a buckle, as non-exclusive examples. More specifically, in one embodiment, the adjustable member 22 can include a double-holed spring-toggled adjuster. In alternative embodiments, the adjustable member 22 can include any spring-toggled adjuster. Additionally, and/or alternatively, the adjustable member 22 can include any other suitable device and/or adjuster that allows the adjustable member 22 to be selectively moved and/or adjusted at any location along the tether member 20.

In various embodiments, the adjustable member 22 can be connected to the tether member 20. In such embodiments, the adjustable member 22 can be manipulated by the dancer 10 to be selectively moved and/or adjusted to different locations along the tether member 20. Alternatively, the adjustable member 22 can also lock to the tether member 20 when not being manipulated by the dancer 10. In some embodiments, as the adjustable member 22 is moved and/or adjusted, the adjustable member 22 can also cause a length of the central end 24, the first tether side 26 and the second tether side 28 to vary and/or change. In various embodiments, the resistance of the tether member 20, including the first tether side 26 and the second tether side 28, can also vary as the adjustable member 22 is moved and/or adjusted.

Additionally, the adjustable member 22 can be configured to connect, secure and/or attach the tether member 20 to the object 14 via the central end 24. For example, in various embodiments, the adjustable member 22 and the central end 24 can form a loop. In such embodiments, the adjustable member 22 can be manipulated by the dancer 10 to move along the tether member 20 to a position substantially adjacent to the object 14. In other words, the dancer 10 can selectively move and/or adjust the adjustable member 22 to tighten the loop against the object 14. Once desired tautness is achieved, the adjustable member 22 can also lock to the tether member 20, i.e., become substantially immovable when not manipulated by the dancer 10.

The handles 18A, 18B, can be engaged, gripped or otherwise held by one or more hand(s), fingers and/or fingertips of the dancer 10. Although the dancer 10 illustrated in FIG. 1 is shown gripping the handles 18A, 18B, it is recognized that the dancer 10 can also engage the handles 18A, 18B, without fully gripping the handles 18A, 18B. Further, as provided herein, the configuration of the handles 18A, 18B, can be such that the dancer 10 can engage both handles 18A, 18B, simultaneously with onehand, for example, by crossing the handles 18A, 18B, one over the other.

The design of the handles 18A, 18B, can vary. In certain non-exclusive embodiments, the handles 18A, 18B, can have a somewhat J-shaped or C-shaped configuration. In some embodiments, the handles 18A, 18B, can include linear legs and/or segments (illustrated in FIG. 2A, for example). In other embodiments, the handle 18 can include curved legs and/or segments (illustrated in FIG. 4A, for example). The handles 18A, 18B, can include any number of linear and/or curved legs and/or segments. Alternatively, the handles 18A, 18B, can have another suitable design. In certain non-exclusive embodiments, the handles 18A, 18B, can have a somewhat elliptical, circular, egg-shaped, triangular, square and/or rectangular cross-sectional shape. As used herein, "somewhat" in this context may not necessarily mean exactly elliptical, circular, triangular, square and/or rectangular, and there may be subtle variations with the shape. In alternative embodiments, the handles 18A, 18B, can have any other suitable cross-sectional shape.

In various embodiments, the dance practice assembly 12 can include more than one handle 18. As shown in the embodiment in FIG. 1, the dance practice assembly 12 can include two handles, a first handle 18A and a second handle 18B that is coupled to the first handle 18A via the tether member 20. It is recognized that the terms "first handle 18A" and "second handle 18B" can be used interchangeably. In other words, either handle can be the first handle 18A or the second handle 18B. In FIG. 1, the handles 18A, 18B can be connected, secured and/or attached to the tether member 20. More specifically, the first handle 18A can be connected, secured and/or attached to the first tether side 26 and the second handle 18B can be connected, secured and/or attached to the second tether side 28. The handles 18A, 18B can be connected, secured and/or attached to the tether member 20 at any location along the first tether side 26 and the second tether side 28. Alternatively, the tether member 20 can be connected, secured and/or attached at any location on the handles 18A, 18B. Further, the handles 18A, 18B and the tether member 20 can be secured and/or connected via any suitable manner, i.e., clamp, knot, an adhesive, a bonding material, etc.

In the embodiments described herein, the handles 18A, 18B can be substantially similar in the design, configuration and/or shape. In alternative embodiments, the first handle 18A and the second handle 18B can have different designs, configurations and/or shapes from one another. In still another embodiment, each handle 18A, 18B, can be individually and/or independently connected to the object 14 via a corresponding tether member 20.

Figure 2A:
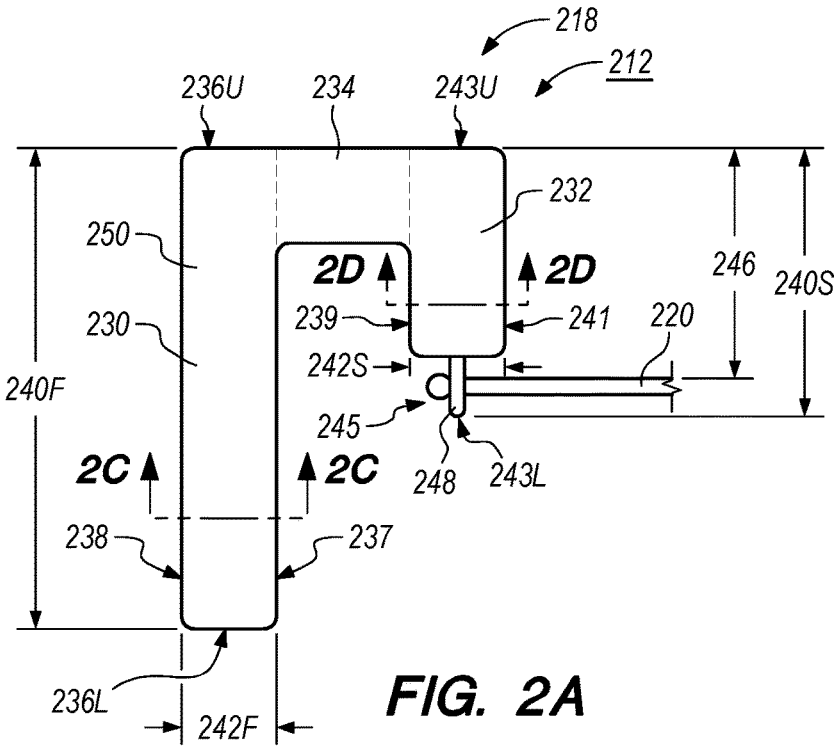
FIG. 2A is a side view of an embodiment of a handle for the dance practice assembly.

FIG. 2A is a side view of an embodiment of the handle 218 for the dance practice assembly 212. The design of the handle 218 can be varied. In the embodiment illustrated in FIG. 2A, the handle 218 includes linear legs and/or segments that form a somewhat J-shaped design and/or shape. In alternative embodiments, the handle 218 can include any other suitable design and/or shape. In this embodiment, the handle 218 can include one or more of a first leg 230, a second leg 232 and a third leg 234. It is recognized that the handle 218 can include fewer or additional components than those specifically illustrated and described herein.

The first leg 230 can be engaged, gripped or otherwise held by the dancer 10 (illustrated in FIG. 1). In certain embodiments, the first leg 230 can include a first lower end 236L, a first upper end 236U, a first inner surface 237, a first outer surface 238, a first length 240F and a first width 242F. It is recognized that the terms "upper" and "lower" are used herein as a matter of reference only and are not intended to limit or provide any specific orientation of the handle 218.

As used herein, the first length 240F is intended to represent the distance between the first lower end 236L and the first upper end 236U. Further, the first width 242F means the distance between the first inner surface 237 and the first outer surface 238. The first length 240F and the first width 242F can vary depending upon the design requirements of the handle 218. In some embodiments, the first width 242F can include a uniform width along the first length 240F of the first leg 230. In other embodiments, the first width 242F can vary along the first length 240F of the first leg 230.

Additionally, in the embodiment illustrated in FIG. 2A, the first inner surface 237 extends between the first lower end 236L and near an intersection of the first leg 230 and the third leg 234. In certain embodiments, the first inner surface 237 can be somewhat curved. In other embodiments, the first inner surface 237 can be somewhat flat. In yet other embodiments, the first inner surface 237 can include ridges and/or curves to ergonomically fit the fingers of the dancer 10. Additionally, and/or alternatively, the first inner surface 237 can include any other suitable surface that allows the dancer 10 to grip, hold or otherwise engage the handle 218.

The second leg 232 can be configured to allow attachment of the tether member 220 to the handle 218. As certain non-exclusive examples, the tether member 220 can be connected, secured and/or attached to the second leg 232 via clamp, knot, adhesive, bonding material, etc. Alternatively, the tether member 220 can be connected, secured and/or attached to the second leg 232 via any suitable manner and/or method. In certain embodiments, the second leg 232 can include a second lower end 243L, a second upper end 243U, a second inner surface 239, a second outer surface 241, a second length 240S and a second width 242S.

As used herein, the second length 240S is intended to represent the distance between the second lower end 243L and the second upper end 243U. Further, the second width 242S is intended to represent the distance between the second inner surface 239 and the second outer surface 241. The second length 240S and the second width 242S can vary depending upon the design requirements of the handle 218. In some embodiments, the second width 242S can include a uniform width along the second length 240S of the second leg 232. In other embodiments, the second width 242S can vary along the second length 240S of the second leg 232.

In certain embodiments, the second leg 232 can also include an attachment site 245 and a second attachment length 246. The attachment site 245 can include the location where the tether member 220 is connected, secured and/or attached to the second leg 232. In one embodiment, the attachment site 245 can include an aperture through which the tether member 220 can be connected, secured and/or attached to the second leg 232. In other non-exclusive embodiments, the attachment site 245 can include clips, clamps, etc. In various embodiments, the attachment site 245 can be positioned at any suitable location on the second leg 232.

In the embodiment illustrated in FIG. 2A, the second attachment length 246 is intended to represent the distance between the attachment site 245 and the second upper end 243U. The second attachment length 246 can be varied depending upon the design of the handle 218.

In various embodiments, the first length 240F can be different than the second attachment length 246. For example, a ratio of the first length 240F to the second attachment length 246 can vary. In certain embodiments, the ratio of the first length 240F to the second attachment length 246 can be at least approximately 1:1 and less than approximately 2:1. In some embodiments, the ratio of the first length 240F to the second attachment length 246 can be at least approximately 1.25:1, 1.5:1 or 1.75:1. Alternatively the ratio of the first length 240F to the second attachment length 246 can be greater than approximately 2:1 or less than 1:1.

In other embodiments, the first length 240F can be greater than the second attachment length 246. In certain embodiments, the first length 240F can be at least approximately 10%, 25%, 50%, 75%, 100% or 125% greater than the second attachment length 246. In the embodiment illustrated in FIG. 2A, the first length 240F is approximately 100% greater than the second attachment length 246. In this embodiment, where the first length 240F is approximately 100% greater than the second attachment length 246, a more balanced force acting on the handle 218 during use of the dance practice assembly 212 is achieved. In other words, the likelihood of creating a moment or rotational force during use of the dance practice assembly 212 is decreased. Accordingly, the dancer 10 can engage, grip and/or hold the handle 218 in a more realistic manner that better mimics the presence and/or feel of a dancer partner with less likelihood of unwanted movement (i.e. excessive torque, twisting, rotation, etc.) of the handle 218 in the hand, fingers and/or fingertips of the dancer 10.

Additionally, in certain embodiments, the first length 240F can be greater than the second length 240S. For example, the ratio of the first length 240F to the second length 240S can vary. In certain embodiments, the ratio of the first length 240F to the second length 240S can be greater than approximately 1:1 and less than approximately 2:1. In some embodiments, the ratio of the first length 240F to the second length 240S can be at least approximately 1.25:1, 1.5:1 or 1.75:1, as non-exclusive examples. Alternatively, the ratio of the first length 240F to the second length 240S can be greater than 2:1 or less than 1:1.

In the embodiment illustrated in FIG. 2A, the second leg 232 can be approximately parallel to the first leg 230. In this context, "approximately parallel" can mean there may be a minor variance between the distance of the first leg 230 to the second leg 232 at certain points along the first leg 230 and/or the second leg 232, such as by less than or equal to approximately 10 degrees. In other words, the first leg 230 and the second leg 232 may be slightly off parallel, i.e., the distance between the first leg 230 and the second leg 232 may not be precisely equidistant along the length of the first leg 230 and the second leg 232.

The third leg 234 connects the first leg 230 and the second leg 232 to one another. In certain embodiments, the dimensions of the third leg 234 can be varied. The first leg 230 and the second leg 232 can be connected to the third leg 234 via any suitable manner. In the embodiment illustrated in FIG. 2A, the third leg 234 is substantially linear. In FIG. 2A, the first leg 230 and the second leg 232 are connected to the third leg 234 so that the third leg 234 is approximately perpendicular to each of the first leg 230 and the second leg 232. In another embodiment, the third leg 234 can be approximately perpendicular to at least one of the first leg 230 and the second leg 232. As used herein, "approximately perpendicular" may not necessarily mean exactly perpendicular (a 90 degree angle) and there may be minor variance of an angle where the third leg 234 intersects the first leg 230 and the second leg 232, such as by less than 10 degrees from perpendicular. In alternative embodiments, the first leg 230 and the second leg 232 can be connected to the third leg 234 so that the third leg 234 is less than 80 degrees or greater than 100 degrees to at least one of the first leg 230 and the second leg 232. Additionally, and/or alternatively, the third leg 234 can be substantially curved, i.e. C-shaped or another suitable curved shape.

In various embodiments, the handle 218 can further include a handle body 248 and a body cover 250. The handle body 248 can form a rigid core of the handle 218. The design of the handle body 248 can vary. In certain embodiments, the tether member 220 can be connected, secured and/or attached to the handle body 248. In the embodiment illustrated in FIG. 2A, the handle body 248 can include the attachment site 245, through which a portion of tether member 220 can extend to connect to the handle body 248. In some embodiments, the handle body 248 can be formed from a relatively rigid material, such as a metal or metal alloy (stainless steel, titanium, aluminum, etc.), a composite material, ceramic, or a relatively rigid plastic, as non-exclusive examples. In one embodiment, the handle body 248 can be formed from a material that is more rigid than a material that forms the body cover 250. Alternatively, the handle body 248 can be formed from any other suitable material.

The body cover 250 substantially covers and/or surrounds at least a portion of the handle body 248. In some embodiments, the body cover 250 substantially covers and/or surrounds at least a portion of the first leg 230, the second leg 232 and the third leg 234. In other embodiments, the body cover 250 completely surrounds and/or covers the first leg 230, the second leg 232 and/or the third leg 234. In the embodiment illustrated in FIG. 2A, the body cover 250 completely covers and/or surrounds the first leg 230 and the third leg 234, but only covers and/or surrounds a portion of the second leg 232, allowing a portion of the handle body 248 of the second leg 232 to be exposed. In some embodiments, the body cover 250 can be formed from a material more resilient than the material that forms the handle body 248, such as a rubber material, plastic, a foam material or a silicone, as non-exclusive examples. In other embodiments, the body cover 250 can be formed from any other suitable, relatively resilient material. Still alternatively, the handle 218 can omit one or the other of the handle body 248 or the body cover 250 so that the handle 218 is formed from one type of material.

Figure 2B:
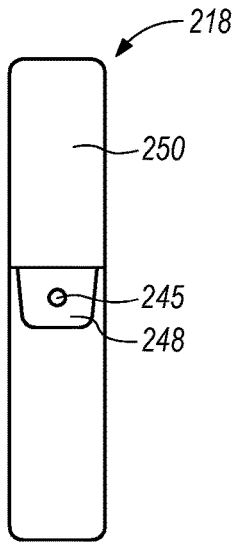
FIG. 2B is a front view of the embodiment of the handle in FIG. 2A.

FIG. 2B is a front view of the embodiment of the handle 218 in FIG. 2A. In the embodiment illustrated in FIG. 2B, the handle 218 includes the handle body 248 and the body cover 250. In this embodiment, the attachment site 245 is located on the handle body 248. For example, in one embodiment, the attachment site 245 can include the aperture through which a portion of tether member 220 (illustrated in FIG. 2A) can be connected to the handle body 248. However, any other suitable configuration that allows attachment of the tether member 220 to the handle body 248 can be used.

Figure 2C:
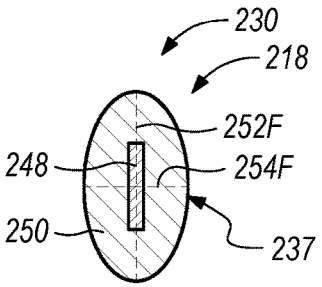
FIG. 2C is a cross-sectional view of the handle taken on line 2C-2C in FIG. 2A.

FIG. 2C is a cross-sectional view of the first leg 230 of the handle 218 taken on line 2C-2C in FIG. 2A. In the embodiment illustrated in FIG. 2C, the first leg 230 includes the handle body 248 and the body cover 250. In FIG. 2C, the handle body 248 can have a somewhat rectangular cross-sectional shape. In other embodiments, the handle body 248 can have a somewhat elliptical, circular, triangular and/or square cross-sectional shape. Alternatively, the handle body 248 can have any other suitable cross-sectional shape. Still alternatively, the handle body 248 can have a somewhat skeletal configuration. In one embodiment, the skeletal configuration can resemble generally the shape of the body cover 250.

In the embodiment illustrated in FIG. 2C, the body cover 250 and/or the first leg 230 of the handle 218 have a somewhat elliptical cross-sectional shape, including a first major axis 252F and a first minor axis 254F. The first major axis 252F and the first minor axis 254F can vary depending upon the design requirements of the handle 218. In other embodiments, the body cover 250 and/or the first leg 230 can have a somewhat circular, triangular, rectangular and/or square cross-sectional shape. Alternatively, the body cover 250 and/or the first leg 230 can have any other suitable cross-sectional shape and/or can have rounded corners, for example.

In various embodiments, the first major axis 252F and the first minor axis 254F can differ from one another. For example, in certain embodiments, a ratio of the first major axis 252F to the first minor axis 254F can be greater than approximately 1:25:1 and less than approximately 2:1. In some embodiments, the ratio of the first major axis 252F to the first minor axis 254F can be at least approximately 1.5:1 or 1.75:1. Alternatively, the ratio of the first major axis 252F to the first minor axis 254F can be greater than 2:1.

Additionally, in the embodiment illustrated in FIG. 2C, the first leg 230 of the handle 218 includes the first inner surface 237. In this embodiment, the first inner surface 237 is somewhat curved as a result of the somewhat elliptical cross-sectional shape. The somewhat curved first inner surface 237 can provide the dancer 10 (illustrated in FIG. 1) with a more realistic feel as the curved first inner surface 237 can more realistically mimic the contours and/or feel of a hand and/or body of the dance partner.

Figure 2D:
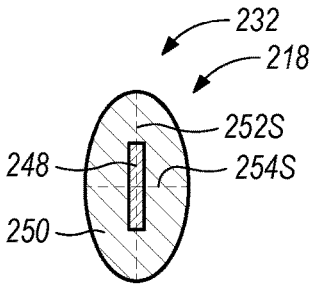
FIG. 2D is a cross-sectional view of the handle taken on line 2D-2D in FIG. 2A.

FIG. 2D is a cross-sectional view of the second leg 232 of the handle 218 taken on line 2D-2D in FIG. 2A. In the embodiment illustrated in FIG. 2D, the second leg 232 includes the handle body 248 and the body cover 250. In this embodiment, the body cover 250 and/or the second leg 232 have a somewhat elliptical cross-sectional shape, including a second major axis 252S and a second minor axis 254S. Alternatively, the body cover 250 and/or the second leg 232 can have any other suitable cross-sectional shape and/or can have rounded corners, for example.

In various embodiments, the second major axis 252S and the second minor axis 254S can differ from one another. For example, in certain embodiments, the ratio of the second major axis 252S to the second minor axis 254S can be greater than approximately 1.1:1 and less than approximately 2:1. More particularly, in some embodiments, the ratio of the second major axis 252S to the second minor axis 254S can be at least approximately 1.5:1 or 1.75:1. Alternatively, the ratio of the second major axis 252S to the second minor axis 254S can be greater than 2:1.

Figure 3A:
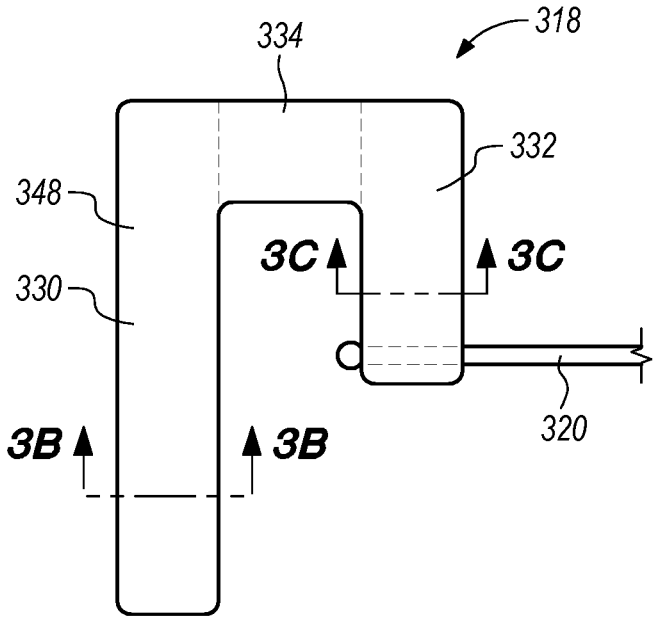
FIG. 3A is a side view of another embodiment of the handle.

FIG. 3A is a side view of another embodiment of the handle 318. In the embodiment illustrated in FIG. 3A, the handle 318 includes the first leg 330, the second leg 332 and the third leg 334. The embodiment in FIG. 3A is substantially similar to the embodiment in FIG. 2A, except that the body cover 250 (illustrated in FIG. 2A) is omitted. In various embodiments, the handle 318 can omit one or the other of the handle body 348 or the body cover 250 so that the handle 318 is formed as a unitary structure. In certain embodiments, unitary structure means that the handle 318 is homogenously formed from one material, such as a metal or metal alloy (stainless steel, titanium, aluminum, etc.), a composite material, wood, ceramic, or a relatively rigid plastic, as non-exclusive examples.

Furthermore, in the embodiment illustrated in FIG. 3A, the tether member 320 can be connected, secured and/or attached to the handle body 348. In FIG. 3A, the handle body 348 includes an aperture through which a portion of the tether member 320 can be connected to the handle body 348. Alternatively, the tether member 320 can be connected, secured and/or attached to the handle body 348 via any other suitable manner.

Figure 3B:
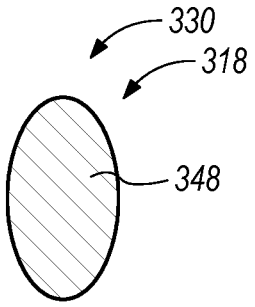
FIG. 3B is a cross-sectional view of the handle taken on line 3B-3B in FIG. 3A.

FIG. 3B is a cross-sectional view of the first leg 330 of the handle 318 taken on line 3B-3B in FIG. 3A. In the embodiment illustrated in FIG. 3B, the first leg 330 of the handle 318 only includes the handle body 348. Further, in this embodiment, the first leg 330 of the handle 318 is homogenously formed from one material or combination of materials.

Figure 3C:
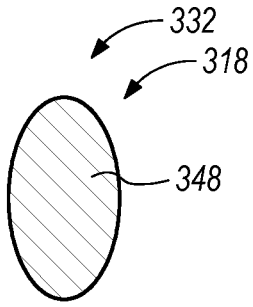
FIG. 3C is a cross-sectional view of the handle taken on line 3C-3C in FIG. 3A.

FIG. 3C is a cross-sectional view of the second leg 332 of the handle 318 taken on line 3C-3C in FIG. 3A. In the embodiment illustrated in FIG. 3C, the second leg 332 of the handle 318 only includes the handle body 348. Further, in this embodiment, the second leg 332 of the handle 318 is homogenously formed from one material, or a combination of materials, or the same material as the first leg 330.

Figure 4A:
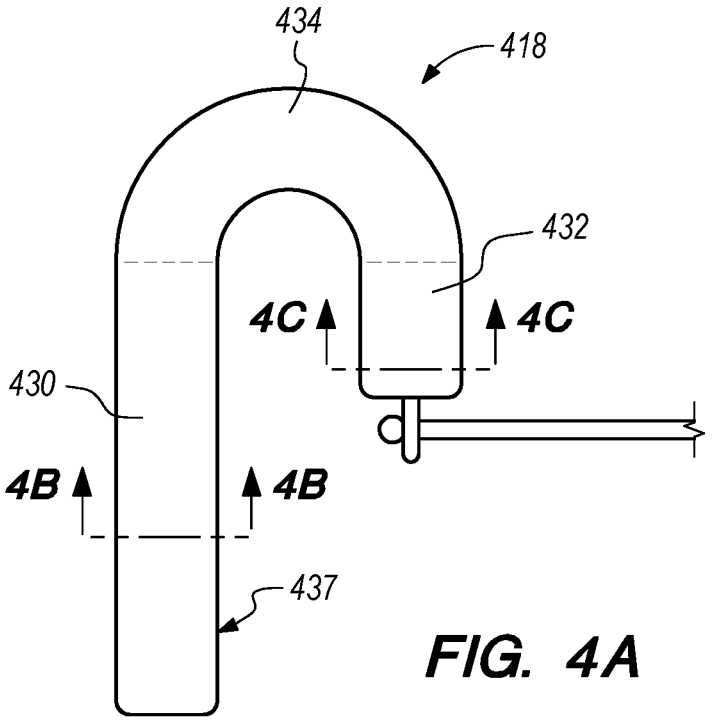
FIG. 4A is a side view of still another embodiment of the handle.

FIG. 4A is a side view of still another embodiment of the handle 418. In the embodiment illustrated in FIG. 4A, the handle 418 includes the first leg 430, the second leg 432, the third leg 434 and the first inner surface 437. More specifically, in this embodiment, the third leg 434, which connects the first leg 430 to the second leg 432, is substantially curved or C-shaped. In other embodiments, the third leg 434 can be another suitable curved shape. In the embodiment illustrated in FIG. 4A, the first leg 430, the second leg 432 and the third leg 434 are also formed as one substantially continuous piece. In other words, the handle 418 may be formed as one substantially continuous material rather than separate definable legs 430, 432, 434, that are connected together.

Figure 4B:
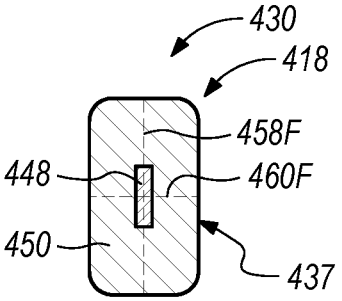
FIG. 4B is a cross-sectional view of the handle taken on line 4B-4B in FIG. 4A.

FIG. 4B is a cross-sectional view of the handle 418 taken on line 4B-4B in FIG. 4A. In the embodiment illustrated in FIG. 4B, the first leg 430 includes a portion of the handle body 448 and the body cover 450. In this embodiment, the body cover 450 and/or the first leg 430 of the handle 418 have a somewhat rectangular cross-sectional shape, including a first major length 458F and a first minor length 460F. The first major length 458F and the first minor length 460F can vary depending upon the design requirements of the handle 418.

In various embodiments, the first major length 458F and the first minor length 460F can differ from one another. For example, in certain embodiments, a ratio of the first major length 458F to the first minor length 460F can be greater than approximately 1.1:1 and less than approximately 2:1. More particularly, in some embodiments, the ratio of the first major length 458F to the first minor length 460F can be at least approximately 1.5:1 or 1.75:1. Alternatively the ratio of the first major length 458F to the first minor length 460F can be greater than approximately 2:1.

Additionally, in the embodiment illustrated in FIG. 4B, the first inner surface 437 is somewhat flat.

Figure 4C:
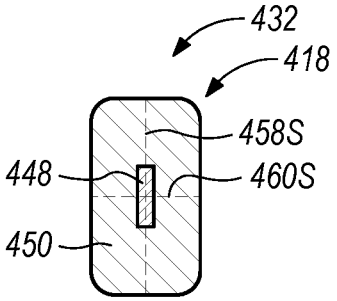
FIG. 4C is a cross-sectional view of the handle taken on line 4C-4C in FIG. 4A.

FIG. 4C is a cross-sectional view of the handle 418 taken on line 4C-4C in FIG. 4A. In the embodiment illustrated in FIG. 4C, the second leg 432 includes a portion of the handle body 448 and the body cover 450. In this embodiment, the body cover 450 and/or the second leg 432 have the somewhat square or rectangular cross-sectional shape, including a second major length 458S and a second minor length 460S. The second major length 458S and the second minor length 460S can vary depending upon the design requirements of the handle 418.

In various embodiments, the second major length 458S and the second minor length 460S can differ from one another. For example, the ratio of the second major length 458S to the second minor length 460S can be greater than approximately 1.1:1 and less than approximately 2:1. More particularly, in some embodiments, the ratio of the second major length 458S to the second minor length 460S can be at least approximately 1.5:1 or 1.75:1. Alternatively the ratio of the second major length 458S to the second minor length 460S can be greater than approximately 2:1.

Figure 5:
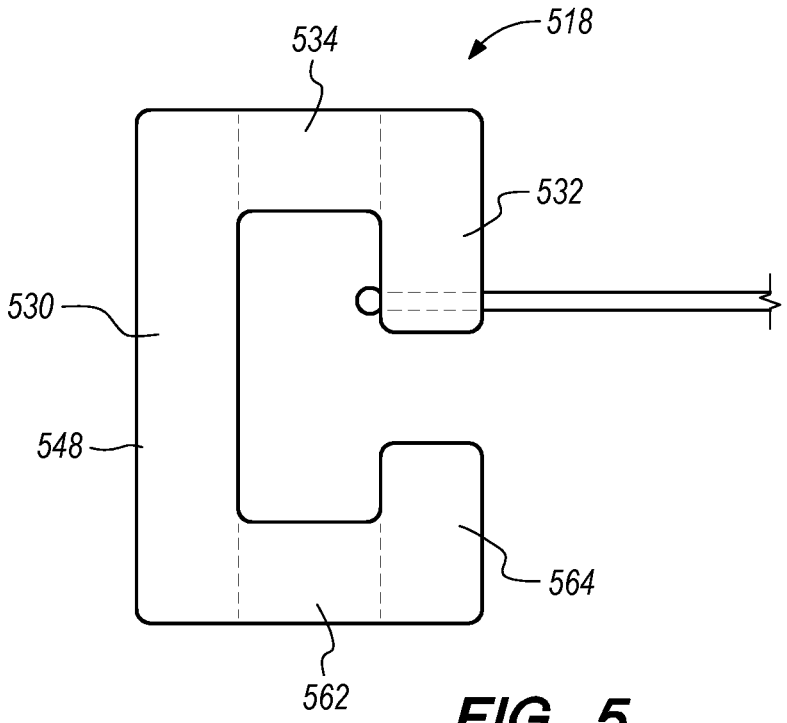
FIG. 5 is a side view of yet another embodiment of the handle.

FIG. 5 is a side view of yet another embodiment of the handle 518. In the embodiment illustrated in FIG. 5, the handle 518 only includes the handle body 548, as the body cover 250 (illustrated in FIG. 2A) has been omitted. In this embodiment, the handle 518 further includes the first leg 530, the second leg 532 and the third leg 534. However, in this embodiment, the handle 518 also includes additional legs and/or segments. More specifically, the handle 518 includes a fourth leg 562 and a fifth leg 564. Alternatively, the handle 518 can include any number of legs, i.e., first, second, third, fourth, fifth, etc. to form any other suitable design, shape and/or configuration.

Figure 6:
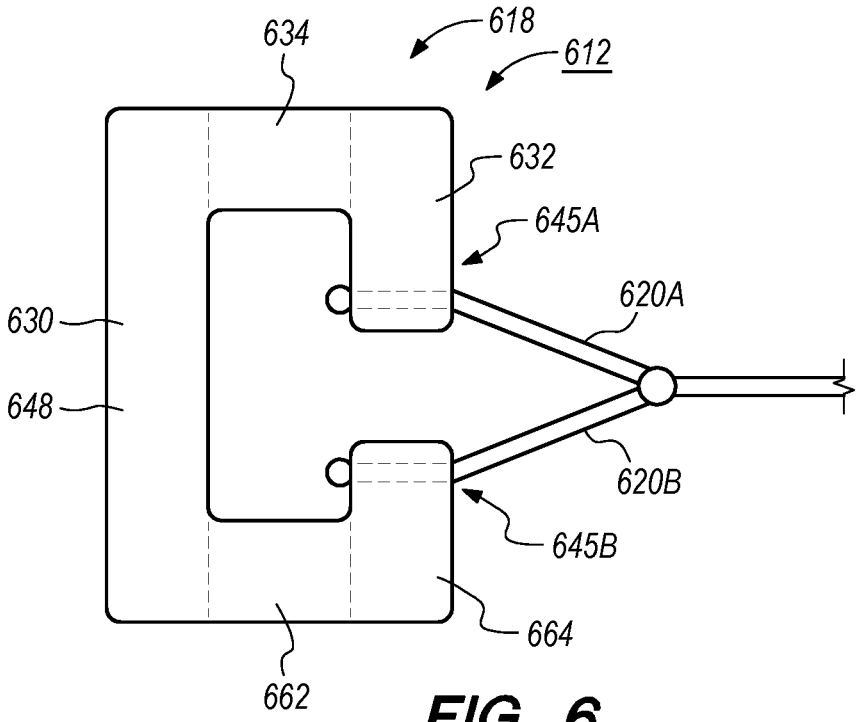
FIG. 6 is a side view of even another embodiment of the handle.

FIG. 6 is a side view of even another embodiment of the handle 618. In the embodiment illustrated in FIG. 6, the handle 618 only includes the handle body 648, as the body cover 250 (illustrated in FIG. 2A) has been omitted. In this embodiment, the handle 618 further includes the first leg 630, the second leg 632, the third leg 634, the fourth leg 662 and the fifth leg 664. However, in this embodiment, the handle 618 includes more than one attachment site 645A, 645B. In FIG. 6, the attachment site 645A is located on the second leg 632 and the attachment site 645B is located on the fifth leg 664. In other embodiments, the attachment sites 645A, 645B can be located at any suitable location on the handle 618. Additionally, and/or alternatively, the handle 618 can include any number of attachment sites, 645A, 645B, i.e., first, second, third, fourth, fifth, etc., which may allow the dancer 10 (illustrated in FIG. 1) to engage, grip and/or otherwise hold the handle 618 in a more realistic manner that better mimics the presence and/or feel of the dancer partner.

Additionally, in certain embodiments, such as the embodiment illustrated in FIG. 6, where there is more than one attachment site 645A, 645B, the handle 618 can also include more than one tether member 620A, 620B. In this embodiment, each tether member 620A, 620B is joined together at a location between the attachment sites 645A, 645B. The tether members 620A, 620B can be joined together via any suitable manner such that a more balanced force acting on the handle 618 during use of the dance practice assembly 612 is achieved. In other words, the tether members 620A, 620B should be joined together in such a manner to decrease the likelihood of creating a moment or rotational force during use of the dance practice assembly 612. In alternative embodiments, the tether members 620A, 620B may not be joined together, but can be separately connected to the object (illustrated in FIG. 1).

It is understood that this disclosure further includes any method for manufacturing the different embodiments of the handle of the dance practice assembly mentioned and/or described herein.

It is further understood that although a number of different embodiments of the handle for the dance practice assembly have been illustrated and described herein, one or more features of any one embodiment can be combined with one or more features of one or more of the other embodiments, provided that such combination satisfies the intent of the present invention.

While a number of exemplary aspects and embodiments of the handle for the dance practice assembly have been shown and disclosed herein above, those of skill in the art will recognize certain modifications, permutations, additions and sub-combinations thereof. It is therefore intended that the consumable shall be interpreted to include all such modifications, permutations, additions and sub-combinations as are within their true spirit and scope, and no limitations are intended to the details of construction or design herein shown.

What is claimed is:

1. A first handle for a dance practice assembly, the first handle being configured to be coupled via a tether assembly to an object that is selectively stationary, the first handle comprising:

a handle body and a non-rotatable handle body cover at least partially disposed on the handle body, the handle body comprising:

a first leg having a first length, the first leg having an elliptical cross-sectional shape; and a second leg having (i) a connected end that is connected to the first leg by a third leg, and (ii) a free end, the second leg being configured to be secured to the tether assembly, the second leg having a second attachment length; and an aperture disposed near the free end of the second leg, the aperture being configured to receive the tether assembly so that the first handle is coupled to the object via the tether assembly, wherein the aperture extends through the second leg in a direction that is toward the first leg;

wherein the first length is at least 100% greater than the second attachment length.

2. The first handle of claim 1 wherein the handle body is formed from one of a composite material and a plastic material.

3. The first handle of claim 1, wherein the third leg is approximately perpendicular to each of the first leg and the second leg.

4. The first handle of claim 1 wherein the handle body is formed from one of a metal, a composite material, and a plastic material.

5. The first handle of claim 1 wherein the body cover is formed from one of a rubber material and a plastic material.

6. The first handle of claim 1 wherein the first leg has a non-circular cross-sectional shape.

7. The first handle of claim 1 wherein the second leg is approximately parallel to the first leg.

8. A dance practice assembly including the first handle of claim 1 and a tether assembly that is secured to the first handle.

9. The dance practice assembly of claim 8 further comprising a second handle that is coupled to the first handle, the second handle being substantially similar to the first handle.

10. The dance practice assembly of claim 8 further comprising the object that is selectively connected to the tether assembly, the object being configured to remain substantially stationary during use of the dance practice assembly.

11. The first handle of claim 1, wherein the first handle has a somewhat J-shaped configuration.

12. A first handle for a dance practice assembly, the first handle being configured to be coupled via a tether assembly to an object that is selectively stationary, the first handle comprising:

a handle body and a non-rotatable handle body cover at least partially disposed on the handle body, the handle body comprising:

a first leg having a first length, the first leg having an elliptical cross-sectional shape; and a second leg having a second attachment length, a free end, and a connected end, the second leg being connected to the first led by a third led, wherein the second led is approximately parallel with the first leg, the second leg including a non-rotatable attachment site disposed near the free end, the attachment site being configured to be secured to the tether assembly, the attachment site including an aperture that extends through the handle body in a direction that is toward the first leg;

wherein the first length is approximately 100% greater than the second attachment length so that a balanced force is created on the first handle during use with the tether assembly and the object.

13. The first handle of claim 12 wherein the third leg is substantially linear, and wherein the third leg is approximately perpendicular to each of the first leg and the second leg.

14. The first handle of claim 12 wherein at least a portion of (i) the first leg, (ii) the second leg, and (iii) the third leg are homogeneously formed as a unitary structure.

15. A dance practice assembly including the first handle of claim 12, a second handle, and a tether assembly that is configured to be secured to an object, the first handle, and the second handle, wherein the first handle and the second handle are substantially similar to one another.

16. A first handle for a dance practice assembly, the first handle being configured to be coupled via a tether assembly to an object that is selectively stationary, the first handle comprising:

a handle body and a non-rotatable handle body cover at least partially disposed on the handle body, the handle body comprising:

a first leg having a first length, the first leg having an elliptical cross-sectional shape;

a second leg that is connected to the first leg by a third lee, the third lee being approximately perpendicular to each of the first lee and the second lee, the second leg being configured to be secured to the tether assembly, the second leg being approximately parallel to the first leg, the second leg having a second attachment length that is not greater than 50% of the first length;

wherein the first handle has a somewhat J-shaped configuration.

17. The first handle of claim 16 wherein at least a portion of (i) the first leg, (ii) the second leg, and (iii) the third leg are homogeneously formed as a unitary structure.

* * * * *